US008297803B2

(12) United States Patent
Chen

(10) Patent No.: US 8,297,803 B2
(45) Date of Patent: Oct. 30, 2012

(54) CONVENIENTLY DEMOUNTABLE ASSEMBLED LAMP

(76) Inventor: Ching-Hui Chen, Huizhou (CN)

( * ) Notice: Subject to any disclaimer, the term of this patent is extended or adjusted under 35 U.S.C. 154(b) by 0 days.

(21) Appl. No.: 12/858,513

(22) Filed: Aug. 18, 2010

(65) Prior Publication Data

US 2012/0044702 A1 Feb. 23, 2012

(51) Int. Cl.
*F21V 11/00* (2006.01)

(52) U.S. Cl. ..... 362/351; 362/353; 362/368; 362/330; 362/410; 362/431; 362/433; 362/458

(58) Field of Classification Search ..... 362/351–358, 362/360, 367, 368, 330, 332, 410, 418, 430, 362/431, 434, 450–452, 189–191, 268, 33, 362/98, 125, 127, 134, 395
See application file for complete search history.

(56) References Cited

U.S. PATENT DOCUMENTS 2,606,280 A * 8/1952 Stroschein ..... 362/357
2,792,491 A * 5/1957 Rand ..... 108/23
3,766,863 A * 10/1973 Swick et al. ..... 108/188
4,727,461 A * 2/1988 Naumoff et al. ..... 362/352
5,758,960 A * 6/1998 Rocque ..... 362/410
6,000,817 A * 12/1999 Chan ..... 362/352
* cited by examiner

*Primary Examiner* — Danielle Allen
(74) *Attorney, Agent, or Firm* — Jackson IPG PLLC

(57) ABSTRACT

The present invention discloses a conveniently demountable assembled lamp. It is mainly composed of stand columns and clapboards, and multiple clapboards divide the stand columns into up and down multiple layers. At least one layer of the lamp is provided with a fixing frame, and a lampshade is connected between the fixing frame and the clapboard at the bottom of the layer; the lampshade is composed of a lampshade top frame, a soft outside cover and a lampshade bottom frame; locating pins extend from the lampshade top frame, and the fixing frame is provided with corresponding locating pin grooves; a central ring is additionally arranged at the central part of the lampshade bottom frame, and at least three support bars are connected between the central ring and the lampshade bottom frame; the lampshade bottom frame is arranged at the clapboard at the bottom of the layer, and the lampshade top frame is located at the inner side of the fixing frame; the locating pins of the lampshade top frame are jammed into the corresponding locating pin grooves of the fixing frame; the center of the clapboard at the bottom of the layer is further provided with a clapboard center hole corresponding to the central ring; a lampholder is mounted to the clapboard center hole and passes through the central ring. The assembled lamp is conveniently demountable, is convenient for daily cleaning, storage and maintenance, can improve the assembly efficiency and be convenient for transportation, and concurrently has multiple functions and strong aesthetic appearance.

7 Claims, 2 Drawing Sheets

CONVENIENTLY DEMOUNTABLE ASSEMBLED LAMP

FIELD OF THE INVENTION

The present invention involves the technical field of lamps, particularly involves a conveniently demountable assembled lamp.

BACKGROUND OF THE INVENTION

The existing lamps in the market have all kinds of structures and types, such as ceiling lamp, flower lamp, pendant lamp, and wall lamp, which have attractive styles, and strong aesthetic appearance. However, the application range of the lamps of the above mentioned types is greatly limited by the factors such as their installation position and immovability. So, vertical lamps appear in the market, which have mobility and no need of being fixedly installed, thereby solving the disadvantages of traditional lamps. However, conventional vertical lamps still have the following disadvantages: (1) because of the influence of the whole structure of conventional vertical lamps, they are not conveniently demountable, so, they are inconvenient for daily cleaning, storage and maintenance; furthermore, non conveniently demountable vertical lamps will also restrict the assembly efficiency at a certain degree, and they are also inconvenient for transportation; (2) conventional vertical lamps generally just have the single function of lighting, but, vertical lamps themselves will have a certain volume, so, vertical lamps with the single function will obviously waste the space.

SUMMARY OF THE INVENTION

An object of the present invention is aiming at the disadvantages of the above mentioned conventional art to provide an assembled lamp, which is conveniently demountable, is convenient for daily cleaning, storage and maintenance, can improve the assembly efficiency and be convenient for transportation, and concurrently has multiple functions and strong aesthetic appearance.

The object of the present invention is achieved as the following.

A conveniently demountable assembled lamp is mainly composed of stand columns and clapboards, and multiple clapboards divide the stand columns into up and down multiple layers, characterized in that at least one layer of the lamp is provided with a fixing frame, and a lampshade is connected between the fixing frame and the clapboard at the bottom of the layer; the lampshade is composed of a lampshade top frame, a soft outside cover and a lampshade bottom frame; locating pins extend from the lampshade top frame, and the fixing frame is provided with corresponding locating pin grooves; a central ring is additionally arranged at the central part of the lampshade bottom frame, and at least three support bars are connected between the central ring and the lampshade bottom frame; the lampshade bottom frame is arranged at the clapboard at the bottom of the layer, and the lampshade top frame is located at the inner side of the fixing frame; the locating pins of the lampshade top frame are jammed into the corresponding locating pin grooves of the fixing frame; the center of the clapboard at the bottom of the layer is further provided with a clapboard center hole corresponding to the central ring; a lampholder is mounted to the clapboard center hole and passes through the central ring. In this assembled lamp, the lamp is divided into multiple layers by the clapboards, and the lampshade is arranged at one of the layers. So, the assembled lamp has the lighting function as conventional lamps, and furthermore, each layer of clapboards (frame body) except the layer of the lampshade also has the function of loading objects. Moreover, the lampshade top frame is fixed to the fixing frame by the combination of the locating pins and the locating pin grooves, and the lampshade bottom frame connects the central ring to the clapboard center hole by the lampholder that is fixed with nuts. So, the structure among the lampshade, the clapboard and the fixing frame is conveniently demountable, which is not only convenient for daily cleaning, storage and maintenance, but also is convenient for transportation and can improve the assembly efficiency of the lamp.

The object of the present invention can also adopt the following technical solutions to solve.

As a preferable technical solution, the horizontal height of the central ring is higher than the horizontal height of the lampshade bottom frame, and each support bars extend upward slantwise. So, enough installation space is provided among the central ring, the lampshade bottom frame and the clapboard to meet the installation requirement of the lampholder.

The upper end and lower end of the lampholder are both provided with thread. The upper end of the lampholder passes through the central ring and is connected to a nut to be fixed. The lower end of the lampholder passes downward through the clapboard center hole and is screwed in a nut to be limited. So, the lampholder acts as a connector to connect the clapboard and the central ring of the lampshade bottom frame together.

As a preferable improvement, the fixing frame is circular or elliptic, and, the lampshade top frame and the lampshade bottom frame are also correspondingly circular or elliptic. The soft outside cover is curved into cylinder shape or elliptic cylinder shape corresponding to the shape of the fixing frame. Of course, the shape of the fixing frame and lampshade can also be designed into various shapes according to the requirement.

As a more specific embodiment, the lampshade top frame is provided with three locating pins, and the fixing frame is provided with three corresponding locating pin grooves, so as to fix the lampshade top frame to the fixing frame by the combination of the locating pins and the locating pin grooves.

For making the lighting effect of the lamp be better, the fixing frame and the lampshade are preferably to be mounted to the top layer of the lamp.

The soft outside cover is made of a semitransparent soft material, of which the outside surface is provided with a pattern layer, so, the aesthetic appearance of the lamp can be greatly improved, and especially when the lamp is lighting, the effect of aesthetic appearance is much better.

The advantages of the present invention are as the following.

(1) In the assembled lamp of the present invention, the lamp is divided into multiple layers by the clapboards, and the lampshade is arranged at one of the layers. So, the assembled lamp has the lighting function as conventional lamps, and furthermore, each layer of clapboards (frame body) except the layer of the lampshade also has the function of loading objects. Moreover, the lampshade top frame is fixed to the fixing frame by the combination of the locating pins and the locating pin grooves, and the lampshade bottom frame connects the central ring to the clapboard center hole by the lampholder that is fixed with nuts. So, the structure among the lampshade, the clapboard and the fixing frame is conveniently demountable, which is not only convenient for daily cleaning, storage and maintenance, but also is convenient for transportation and can improve the assembly efficiency of the lamp.

(2) In this assembled lamp, the soft outside cover is made of a semitransparent soft material, of which the outside surface is provided with a pattern layer, so, the aesthetic appearance of the lamp can be greatly improved, and especially when the lamp is lighting, the effect of aesthetic appearance is much better.

DESCRIPTION OF THE PREFERRED EMBODIMENT

Figure 1:
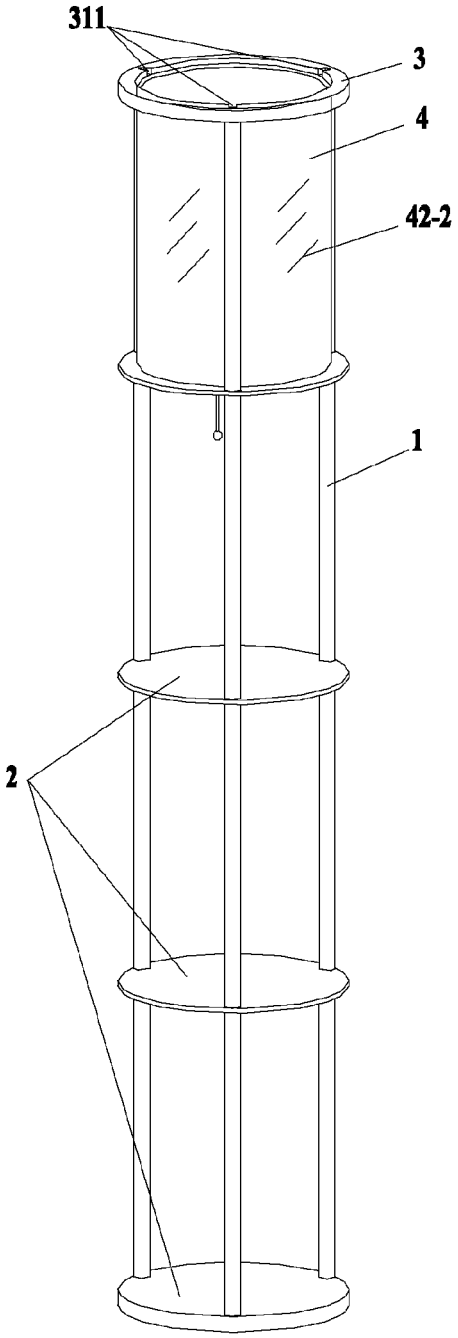
FIG. 1 is a stereo schematic diagram of an assembled lamp of the present invention.
Figure 2:
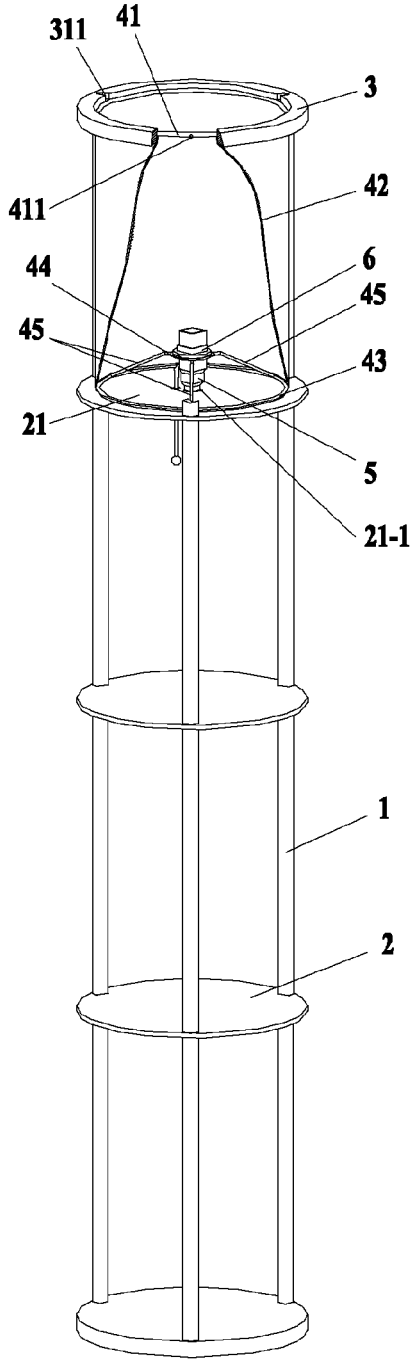
FIG. 2 is a schematic diagram of the assembled lamp in FIG. 1, in which the lampshade is partly cut off.
Figure 3:
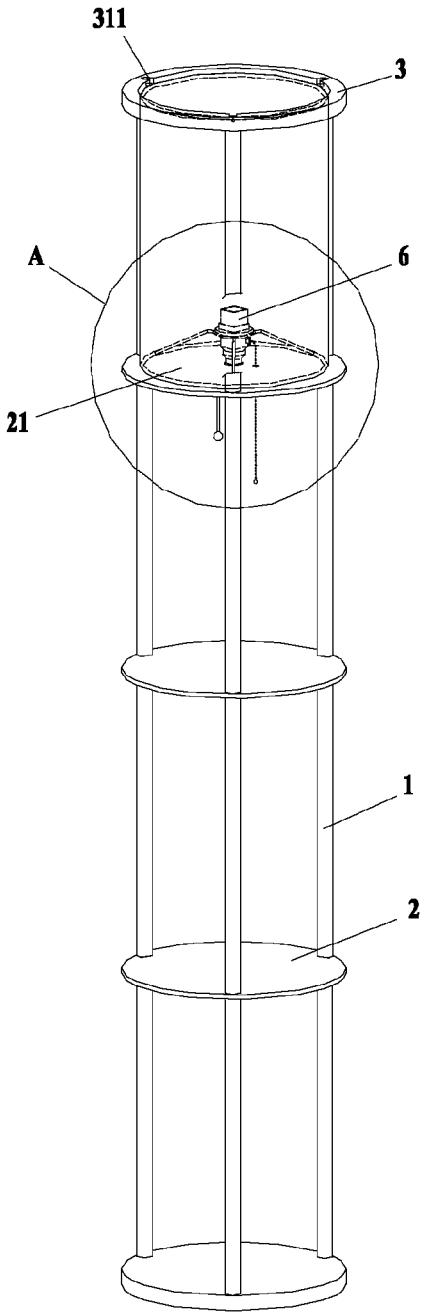
FIG. 3 is a schematic diagram of the assembled lamp in FIG. 1, in which the lampshade has been removed.
Figure 4:
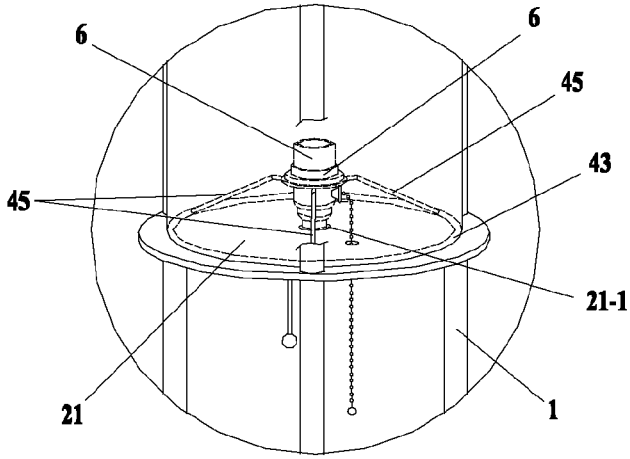
FIG. 4 is an enlarged view of the position A in FIG. 3.
Figure 5:
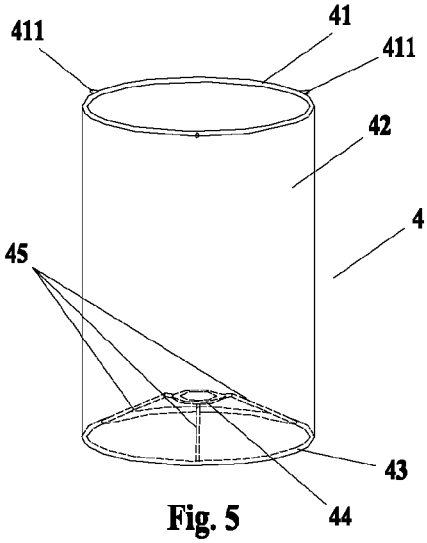
FIG. 5 is an enlarged view of the lampshade of the assembled lamp of the present invention, in which the lampshade is at a perspective state.
Figure 6:
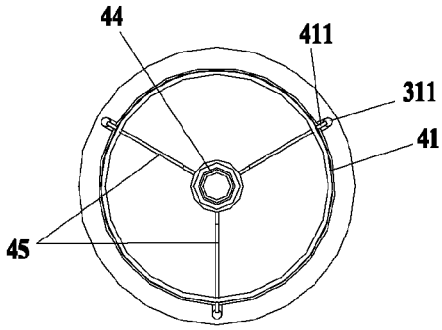
FIG. 6 is a top view of the lampshade of the assembled lamp of FIG. 5.

As shown in from FIG. 1 to FIG. 6, the conveniently demountable assembled lamp is mainly composed of stand columns 1 and clapboards 2, and multiple clapboards 2 connected to the stand columns 1 which divide the lamp into vertically stacked multiple layers. A fixing frame 3 is mounted to the upper part of the top layer of the lamp, and a lampshade 4 is connected between the fixing frame 3 and the clapboard 21 at the bottom of the top layer. The lampshade 4 is composed of a lampshade top frame 41, a soft outside cover 42 and a lampshade bottom frame 43. Three locating pins 411 extend from the lampshade top frame 41, and the fixing frame 3 is provided with three corresponding locating pin grooves 311, so as to fix the lampshade top frame 41 to the fixing frame 3 by the combination of the locating pins 411 and the locating pin grooves 311. The soft outside cover 42 is made of a semitransparent soft material, of which the outside surface is provided with a pattern layer 42-2. A central ring 44 is additionally arranged at the central part of the lampshade bottom frame 43, and at least three support bars 45 are connected between the central ring 44 and the lampshade bottom frame 43. The center of the clapboard 21 at the bottom of the top layer is further provided with a clapboard center hole 21-1 corresponding to the central ring 44, and a lampholder 5 is mounted to the clapboard center hole 21-1 and passes through the central ring 44.

While being mounted, the lampshade top frame 41 is located at the inner side of the fixing frame 3, and the three locating pins 411 of the lampshade top frame 41 are respectively jammed into the corresponding locating pin grooves 311 of the fixing frame 3, so as to firmly fix the lampshade top frame 41 to the fixing frame 3. The lampshade bottom frame 43 is arranged at the clapboard 21 at the bottom of the top layer. The upper end and lower end of the lampholder 5 are both provided with thread. The upper end of the lampholder 5 passes through the central ring 44 and is connected to a nut 6 to be fixed. The lower end of the lampholder 5 passes downward through the clapboard center hole 21-1 and is screwed in a nut to be limited. So, the lampholder 5 acts as a connector to connect the clapboard 21 and the central ring 44 of the lampshade bottom frame 43 together.

As a preferable technical solution, the horizontal height of the central ring 44 is higher than the horizontal height of the lampshade bottom frame 43, and each support bars 45 extend upward slantwise. So, enough installation space is provided among the central ring 44, the lampshade bottom frame 43 and the clapboard 21 to meet the installation requirement of the lampholder 5.

The fixing frame 3 is circular or elliptic, and, the lampshade top frame 41 and the lampshade bottom frame 43 are also correspondingly circular or elliptic. The soft outside cover 42 is curved into cylinder shape or elliptic cylinder shape corresponding to the shape of the fixing frame 3. Of course, the shape of the fixing frame 3 and lampshade 4 can also be designed into various shapes according to the requirement.

This assembled lamp has the lighting function as conventional lamps, and furthermore, each layer of clapboards 2 (frame body) except the layer of the lampshade 4 also have the function of loading objects. Moreover, the lampshade top frame 41 is fixed to the fixing frame 3 by the combination of the locating pins 411 and the locating pin grooves 311, and the lampshade bottom frame 43 connects the central ring 44 to the clapboard center hole 21-1 by the lampholder 5 that is fixed with nuts. So, the structure among the lampshade 4, the clapboard 21 and the fixing frame 3 is conveniently demountable, which is not only convenient for daily cleaning, storage and maintenance, but also is convenient for transportation and can improve the assembly efficiency of the lamp. Furthermore, the soft outside cover 42 is made of a semitransparent soft material, of which the outside surface is provided with a pattern layer, so, the aesthetic appearance of the lamp can be greatly improved, and especially when the lamp is lighting, the effect of aesthetic appearance is much better.

What is claimed is:

1. A conveniently demountable assembled lamp comprising:

a plurality of stand columns and clapboards wherein the plurality of clapboards are connected to the stand columns so as to define vertically stacked multiple layers of the lamp, a fixing frame mounted to an upper part of a top layer of the lamp, a lampshade connected between the fixing frame and the clapboard at the bottom of the top layer; the lampshade comprising:

a lampshade top frame, a soft outside cover, a lampshade bottom frame;

locating pins extending from the lampshade top frame, wherein the fixing frame is provided with corresponding locating pin grooves;

a central ring arranged at a central part of the lampshade bottom frame, and at least three support bars connected between the central ring and the lampshade bottom frame; wherein the lampshade bottom frame is arranged at the clapboard at the bottom of the top layer, and wherein the lampshade top frame is located at an inner side of the fixing frame; and wherein the locating pins of the lampshade top frame are jammed into the corresponding locating pin grooves of the fixing frame; and wherein the center of the clapboard at the bottom of the top layer is further provided with a clapboard center hole corresponding to the central ring; and a lampholder mounted to the clapboard center hole and passing through the central ring.

2. The conveniently demountable assembled lamp of claim 1, wherein the horizontal height of the central ring is higher than the horizontal height of the lampshade bottom frame, and each support bars extend upward slantwise.

3. The conveniently demountable assembled lamp of claim 1, wherein the upper end and lower end of the lampholder are both provided with thread; the upper end of the lampholder passes through the central ring and is connected to a nut to be fixed; the lower end of the lampholder passes downward through the clapboard center hole and is screwed in a nut to be limited.

4. The conveniently demountable assembled lamp of claim 1, wherein the fixing frame is circular or elliptic, and, the lampshade top frame and the lampshade bottom frame are also correspondingly circular or elliptic; the soft outside cover is curved into cylinder shape or elliptic cylinder shape corresponding to the shape of the fixing frame.

5. The conveniently demountable assembled lamp of claim 1, wherein the lampshade top frame is provided with three locating pins, and the fixing frame is provided with three corresponding locating pin grooves, so as to fix the lampshade top frame to the fixing frame by the combination of the locating pins and the locating pin grooves.

6. The conveniently demountable assembled lamp of claim 1, wherein the fixing frame and the lampshade are mounted at the top layer of the lamp.

7. The conveniently demountable assembled lamp of claim 1, wherein the soft outside cover is made of a semitransparent soft material, of which the outside surface is provided with a pattern layer.

* * * * *